United States Patent [19]

Takekawa et al.

[11] Patent Number: 4,691,745

[45] Date of Patent: Sep. 8, 1987

[54] MULTI-NOZZLE WEFT INSERTION DEVICE FOR A FLUIDIC JET SHUTTLELESS-LOOM

[75] Inventors: Yujiro Takekawa, Ishikawa; Fumio Matsuda, Kanazawa, both of Japan

[73] Assignee: Tsudakoma Kogyo Kabushiki Kaisha, Kanazawa, Japan

[21] Appl. No.: 804,480

[22] Filed: Dec. 4, 1985

[30] Foreign Application Priority Data

Dec. 4, 1984 [JP] Japan ..... 59-257009

[51] Int. Cl.[4] ..... D03D 47/30

[52] U.S. Cl. ..... 139/435

[58] Field of Search ..... 139/435; 226/97

[56] References Cited

U.S. PATENT DOCUMENTS 4,436,122 3/1984 Mullekom ..... 139/435

4,552,188 11/1985 Kuda et al. ..... 139/435

*Primary Examiner*—Henry S. Jaudon

*Attorney, Agent, or Firm*—Staas & Halsey

[57] ABSTRACT

A multi-nozzle weft insertion device which includes a weft guide which uses the hydrodynamic principles of fluid flow around a streamlined object to direct wefts from plural nozzles into a channel which can be centrally located with respect to the nozzles. The wefts are pulled along the contour of the guide, which is streamlined toward the channel, by a flow of high pressure air. The wefts can be kept from becoming entangled by adding a partition wing between the nozzles. If the channel is not centrally located each weft can be made to approach the channel by moving a different distance and from a different angle by varying the shape of the guide associated therewith. Both horizontal and vertical deflection of the weft can be controlled by shape.

17 Claims, 25 Drawing Figures

MULTI-NOZZLE WEFT INSERTION DEVICE FOR A FLUIDIC JET SHUTTLELESS-LOOM

BACKGROUND OF THE INVENTION

1. Field of the Invention

The present invention relates to a multi-nozzle weft insertion device for a fluidic jet shuttleless-loom and, more particularly, to a high-performance multi-nozzle weft insertion device which can guide wefts ejected from nozzles precisely into a desired weft-path and insert them into a shed of warps, using the hydrodynamic properties of streamlined objects.

2. Description of the Related Art

A fluidic jet shuttleless-loom is a type of loom in which weft insertion is performed by enveloping the weft in a jetted fluid and using the friction therebetween to move the weft by jet propulsion. A loom using air as an actuating fluid is called an air-jet loom and a loom using water as an actuating fluid is called a water-jet loom.

In the air-jet loom using compressible and easily diffusible air, it is necessary to control the diffusion of the jetted fluid and keep the wefts together, therefore a ledge profile reed is provided having a surface deformed into a channel surrounding the weft-path. Where the ledge profile reed is used in the air-jet loom for single-nozzle weft insertion, that is, the insertion of one weft, no problems occur because it is only necessary to sight the jet orifice of the nozzle into the center of the reed channel. However, where the same reed is used for multi-nozzle weft insertion, that is, the insertion of many different wefts blown from different nozzles, a problem occurs in adjusting the propulsion sight or line of flight of the wefts. It is almost impossible to sight all of the nozzles N, N'. . . at the center of the channel, and, as a result, the discharged weft Y runs against the entrance wall of the channel G of the reed R, resulting in weft insertion failure.

To solve the above-discussed sighting problem, a system for moving nozzles one at a time to individually sight along the weft-path was designed, as disclosed in Japanese Patent Early Publication No. 55-142747. This system, however, cannot be structurally adapted to recent large-sized air-jet looms which require that the nozzles be moved quickly and constantly. In addition, the large systems need to hold the nozzles N, N'. . . together with the reed R in a fixed position on a reed support F as shown in FIG. 1, where D indicates weft measuring and storing devices and Y indicates wefts.

The conventional fixed multi-nozzle weft insertion device overcomes weft insertion failure by (a) reducing nozzle size or (b) enlarging the channel opening as disclosed in Japanese Utility Model Early Publication No. 59-10087.

SUMMARY OF THE INVENTION

It is an object of the present invention to overcome the above-mentioned problems by providing a multi-nozzle weft insertion device that produces a jet flow from a nozzle located out of the weft-path, as a streamlined fluid flow by hydrodynamic means, and that converges the weft carried by the jet flow gradually to the line of sight of the weft-path to thereby insert the weft along the weft-path.

It is another object of the present invention to provide a high-performance multi-nozzle weft insertion device that is simple in structure, operates reliably and loses very little jet energy.

It is a further object of the present invention to provide a multi-nozzle weft insertion device that facilitates the standardization of machine parts and products and has good mass-production capability.

It is an additional object of the present invention to provide a weft insertion device that prevents entanglement of the wefts.

It is still another object of the present invention to provide a weft guide that can control the horizontal and vertical components of weft movement separately or in combination.

The present invention provides a high-performance multinozzle weft insertion device which guides wefts ejected from nozzles into a weft path using the hydrodynamic principles of the Coanda effect. Each group of nozzles includes a weft guide that changes in shape as the distance from the nozzles increases. The changing shape causes air flow to adhere to the guide and directs the weft toward the center of a reed channel. Partitions can be included between guide sections to control air diffusion to prevent weft entanglement. Guides of different shapes the horizontal and vertical components of weft movement to be controlled independently or in combination.

These together with other objects and advantages which will be subsequently apparent, reside in the details of construction and operation as more fully hereinafter described and claimed, reference being had to the accompanying drawing forming a part hereof, wherein like numerals refer to like parts throughout.

DESCRIPTION OF THE PREFERRED EMBODIMENTS

Figure 1:
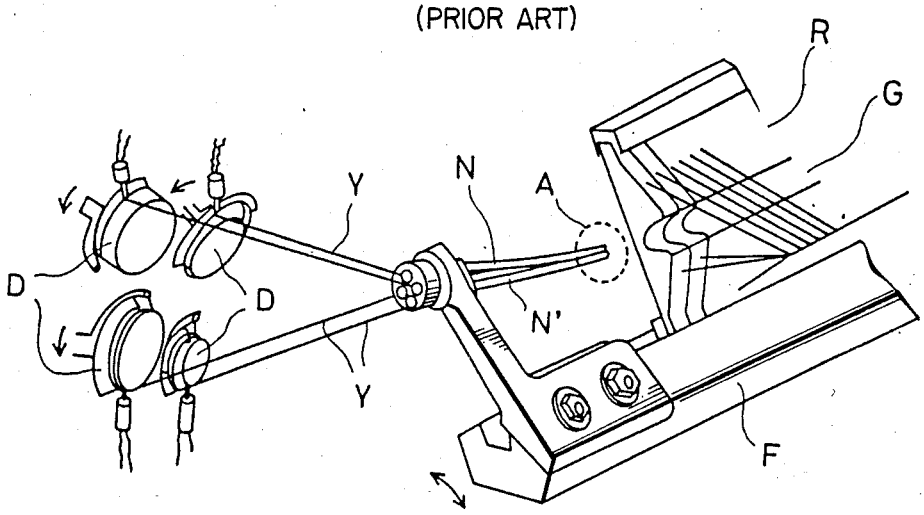
FIG. 1 (PRIOR ART)
FIG. 1 is a perspective view of a conventional multi-nozzle weft insertion device of a fixed-nozzle type.
Figure 2:
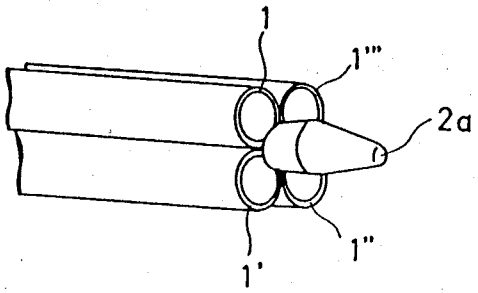
FIG. 2 is a perspective view of a first embodiment of the present invention showing the nozzle end.
Figure 3:
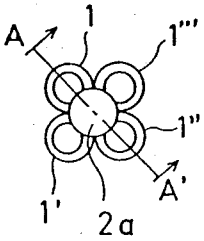
FIG. 3 is a front view of the second embodiment showing the jet orifice end.
Figure 4:
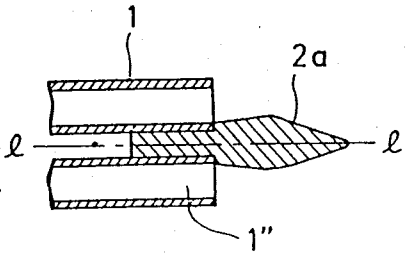
FIG. 4 is a sectional view along the line A—A' of FIG. 3.

The first embodiment of the present invention illustrated in FIGS. 2 to 4 is a quadruple-nozzle weft insertion device having a weft guide 2*a* with a bullet-like or conoid shape. The weft guide 2 is a streamlined object, that is, an object whose curvature does not disrupt the smooth flow of fluid thereacross and causes a high velocity air stream to adhere thereto without causing turbulence. The diameter of the guide 2 increases until a mid point of the streamlined portion and decreases thereafter until it terminates with a pointed end. The weft guide 2*a* is mounted in the center between the four nozzles 1, 1', 1'' and 1''', and positioned in a coaxial relationship with the weft-path line of sight 1—1. The guide 2*a* is positioned to contact the pressurized air discharged from the nozzles. The high velocity air streaming from each nozzle carries a weft. The air stream tends to adhere to the guide 2 in accordance with the Coanda effect. Since the air stream is carrying the weft in the direction of the pointed end which is on the line of sight of the desired weft path. As a result, the wefts are directed toward the center of the reed channel by floating in the air stream redirected by the guide 2.

Figure 5:
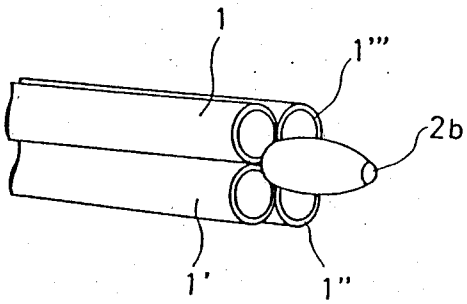
FIG. 5 is a perspective view of a second embodiment of the present invention showing the nozzle end.
Figure 6:
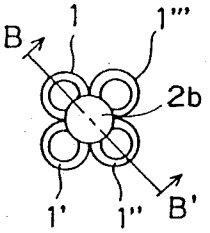
FIG. 6 is a front view of the second embodiment showing the jet orifice end.
Figure 7:
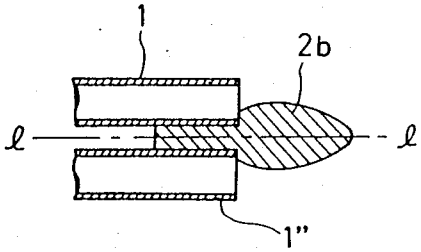
FIG. 7 is a view along the line B—B' of FIG. 6.

A second embodiment of the present invention illustrated in FIGS. 5 to 7 is a quadruple-nozzle weft insertion device having a spindle-like, streamlined weft guide 2*b* which is also mounted in the center between the four nozzles 1, 1', 1'' and 1''', and positioned in a coaxial relationship with the weft-path line of sight 1—1. This embodiment operates in a manner similar to the first embodiment.

Figure 10:
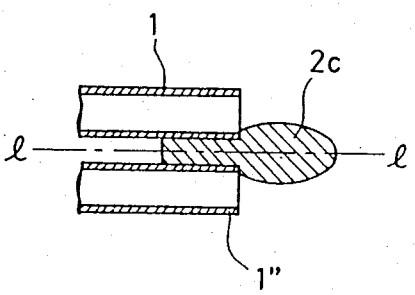
FIG. 10 is a sectional view along the line C—C' of FIG. 9.
Figure 9:
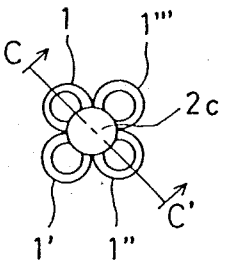
FIG. 9 is a front view of the third embodiment showing the jet orifice end.
Figure 8:
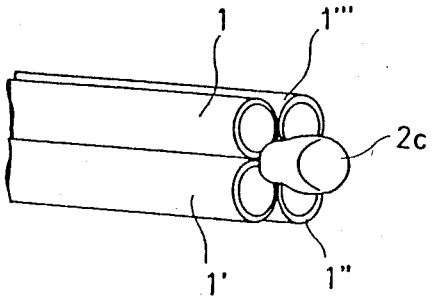
FIG. 8 is a perspective view of a third embodiment of the present invention showing the nozzle end.

A third embodiment of the present invention illustrated in FIGS. 8 to 10 is a quadruple-nozzle weft insertion device having an ovoid-like, streamlined weft guide 2*c* which is mounted in the center between the nozzles 1, 1', 1'' and 1''', and positioned in a coaxial relationship with the weft-path line of sight 1—1.

Figure 11:
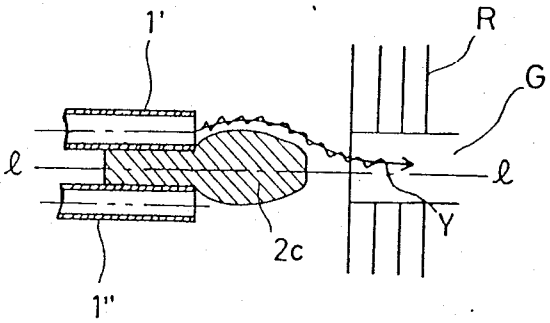
FIG. 11 is a view showing weft blowing conditions of the third embodiment.

FIG. 11 illustrates a modification of the guide 2*c* of FIGS. 5–7 to provide a blunted tip. The blunted tip improves alignment with the weft-path line of sight 1—1. FIG. 11 also illustrates the operation of the present invention. As the weft Y leaves a nozzle, for example, nozzle 1', because it is being carried by the air stream, it hugs or follows the contour of the guide 2*c* until it enters the channel G formed by reeds R.

Figure 14:
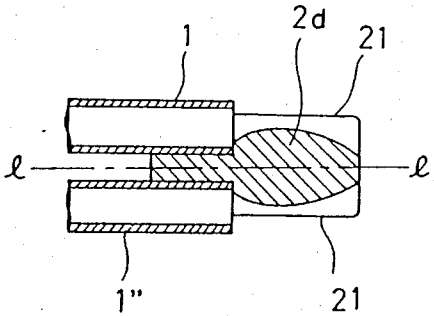
FIG. 14 is a sectional view along the line D—D' of FIG. 13.
Figure 13:
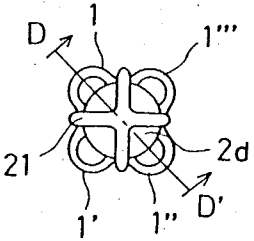
FIG. 13 is a front view of the fourth embodiment showing the jet orifice end.
Figure 12:
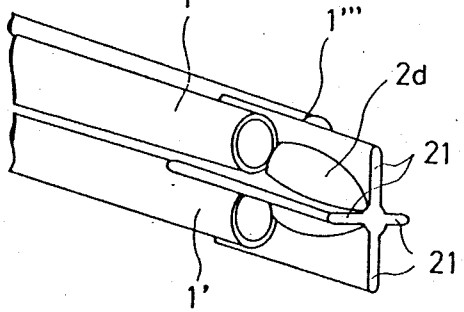
FIG. 12 is a perspective view of a fourth embodiment of the present invention showing the nozzle end.

A fourth embodiment of the present invention illustrated in FIGS. 12 to 14 is a quadruple-nozzle weft insertion device with an ovoid-like, streamlined weft guide 2*d* having partition wings 21. The wings 21 control fluid diffusion in the forward direction of the jet orifices to prevent the end of respective wefts blown from the nozzles 1—1''' from getting tangled. The wings 21 stop entanglement of the wefts by not allowing the diffusing air to mix and swirl as it passes adjacent to guide 2*d*. As in the third embodiment, the weft guide 2*d* is mounted in the center between the four nozzles 1, 1', 1'' and 1''', and positioned in a coaxial relationship with the weft-path line of sight 1—1.

Figure 15:
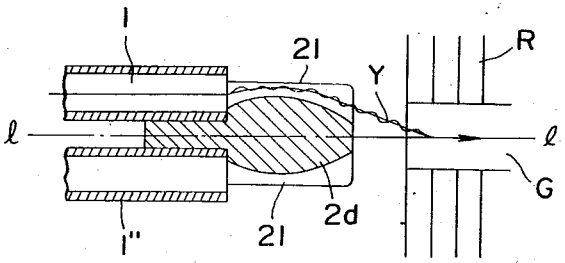
FIG. 15 is a view showing the weft blowing condition of the fourth embodiment.

FIG. 15 illustrates how the fourth embodiment including wings or partitions 21 operates. Once again, as each weft Y leaves a nozzle carried by an air stream, it follows the contour of the guide 2*d* while remaining between the wings 21 and is propelled down the center of channel G between reeds R along the weft-path line of sight 1—1.

Figure 18:
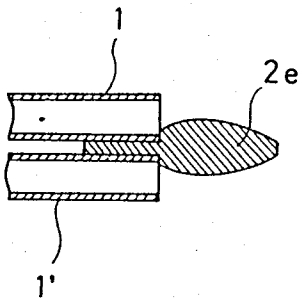
FIG. 18 is a sectional view along the line E—E' of FIG. 17.
Figure 17:
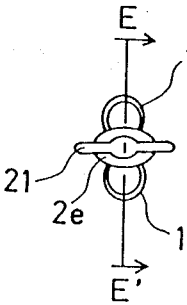
FIG. 17 is a front view of the fifth embodiment showing the jet orifice end.
Figure 16:
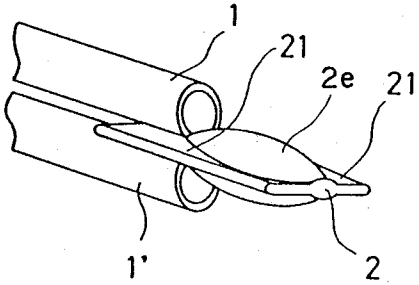
FIG. 16 is a perspective view of a fifth embodiment of the present invention constructed as a double-nozzle weft insertion device.

A fifth embodiment of the present invention illustrated in FIGS. 16 to 18 is a double-nozzle weft insertion device having a partition wing 21 for partitioning two superposed nozzles 1 and 1'. The partition wing 21 has its upper and lower surfaces swelled into a long, elliptical streamlined shape to form a weft guide 2*e*. This embodiment operates in a manner similar to previous embodiments in that the weft carried by the air stream follows the contour of the swell to be positioned in the center of a channel. However, this embodiment only provides minimal weft movement along the horizontal axis while providing substantial weft movement along the vertical axis.

Figure 21:
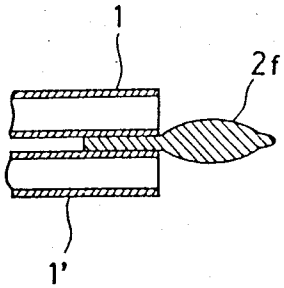
FIG. 21 is a section view along the line F—F' of FIG. 20.
Figure 20:
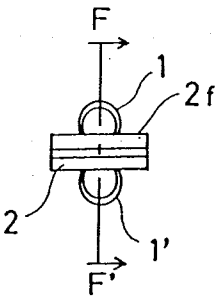
FIG. 20 is a front view of the sixth embodiment showing the nozzle end portion.
Figure 19:
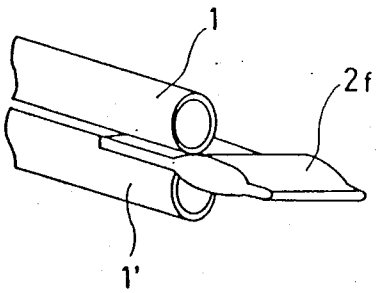
FIG. 19 is a perspective view of a sixth embodiment of the present invention constructed as a double-nozzle weft insertion device.

A sixth embodiment of the present invention illustrated in FIGS. 19 to 21 is a double-nozzle weft insertion device having a sheet-like, streamlined weft guide 2*f* which is thicker in the middle and which is positioned between the two superposed nozzles 1 and 1''. This embodiment is used when the weft only needs to be curved in one direction, in this instance vertically.

Figure 22:
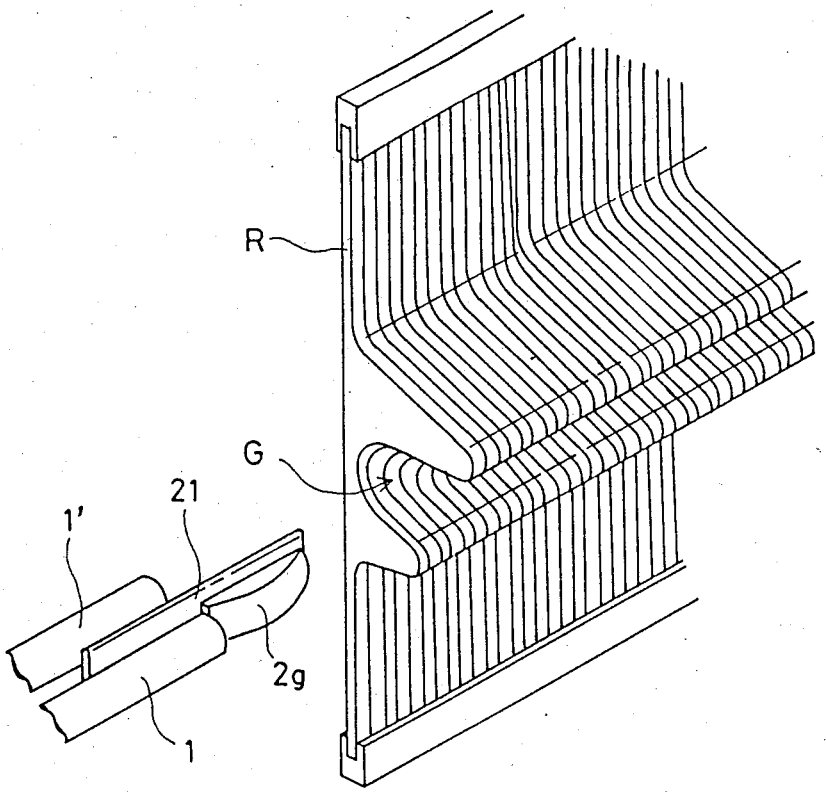
FIG. 22 is a perspective view of a seventh embodiment of the present invention constructed as a double-nozzle weft insertion device having a streamlined weft guide provided for only one of the two nozzles.

A seventh embodiment of the present invention illustrated in FIG. 22 is a double-nozzle weft insertion device in which the nozzles 1 and 1' are horizontally and adjacently positioned side by side and a streamlined weft guide 2*g* is provided to interact only with the jet orifice of the nozzle located on the outer side of the reed R to hydrodynamically, due to the Coanda effect bring the blown weft into the line of sight of the weft-path. In this embodiment, a sheet-like streamlined weft guide 2*g* is provided at the outer surface of partition wing 21 inserted between the nozzles 1 and 1'. The weft guide 2*g* moves only one weft and moves it in a horizontal direction.

Figure 23:
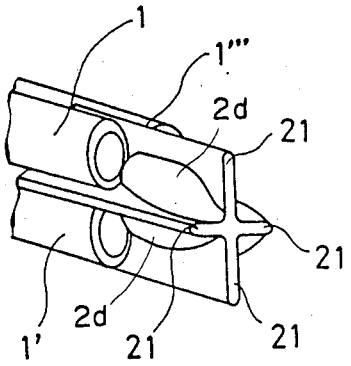
FIG. 23 is a perspective view of the eighth embodiment as seen from a first side.
Figure 24:
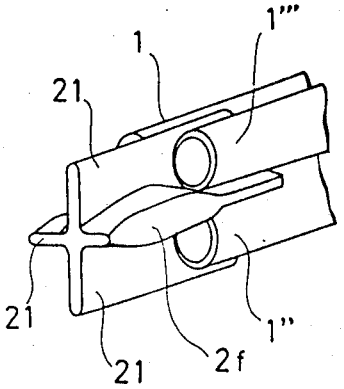
FIG. 24 is a perspective view of the eighth embodiment as seen from a second side.
Figure 25:
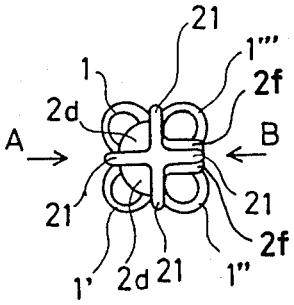
FIG. 25 is a front view of the eighth embodiment showing the jet orifice end.

An eighth embodiment of the present invention illustrated in FIGS. 23 to 25 is a modification of the fourth embodiment described herein, in which partition wings 21 are positioned adjacent to the jet orifice of the nozzles 1, 1', 1'' and 1''' and weft guides 2*d* and 2*f*, having different shapes and/or streamline curvatures (see particularly FIG. 25), are provided according to the locational relationship between the jet orifice and the weft-path. The different shaped guides 2*d* and 2*f* will move the wefts in a different manner toward the channel. With respect to FIG. 25, weft guide 2*d* will move a weft both horizontally and vertically while guide 2*f* will move the weft vertically. The guide of FIGS. 23–25 is particularly suitable for a channel with a weft path line of sight offset toward the B side of the guide as illustrated in FIG. 25. Thus, the shape of the guide depends on the distance and direction of desired weft movement.

Selection of the appropriate weft guide for a particular situation depends on the quality and weight of the weft and is within the ordinary skill in the art.

The various embodiment of the present invention have been described above and include in common a weft guide streamlined toward the direction of the jet flow on at least one of the nozzles 1, 1', 1'' and 1'''. The weft guide for each jet orifice of the nozzle causes the weft Y blown from each nozzle along with the actuating fluid, to converge along a boundary-layer flow which is produced by the fluid on the streamlined wall surface of the guide. The weft is moved gradually toward the weft path line of sight 1—1, by moving adjacent to the wall surface and, as a result, will be guided precisely toward the center of the channel G which is an the extension of the line of sight 1—1, as particularly illustrated in FIGS. 11 and 15.

According to the present invention, a weft blown from each nozzle will travel along the wall surface of the streamlined weft guide under the influence of the boundary-layer flow formed on the circumferential surface of the guide and will be gradually guided toward the weft-path line of sight without meeting any fluidic resistance. The present invention will not cause weft insertion failure, does not require such conventional steps as miniaturizing the nozzle or enlarging the channel and assures weft insertion into the reed channel. The weft insertion device according the present invention will improve performance and reliability using a mechanism which is much simpler than other conventional mechanisms used to prevent failure during insertion, and furthermore, the present invention will improve the performance of a multi-nozzle weft insertion device for a fluidic jet shuttleless-loom represented by an air-jet loom.

The many features and advantages of the invention are apparent from the detailed specification and thus it is intended by the appended claims to cover all such features and advantages of the invention which fall within the true spirit and scope thereof. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

We claim:

1. A multi-nozzle weft insertion device for a fluidic jet shuttleless-loom, comprising:

a group of indepedent nozzles, each nozzle corresponding to a weft to be inserted, each nozzle having a jet orifice and the jet orifice pointing toward a weft-path including a line of sight; and a streamlined weft guide provided at the jet orifice of at least one of said nozzles and having a streamlined wall surface forming a boundary layer flow as a fluid stream passes adjacent thereto, where a weft blown from the at least one nozzle being moved along the boundary-layer flow formed on the streamlined wall surface of said weft guide, being blown gradually to the line of sight of the weft-path and changing the direction of the fluid stream while maintaining a stable fluid stream.

2. A device as recited in claim 1, wherein said group comprises two nozzles and said streamlined weft guide comprises a sheet-like, streamlined weft guide provided at the jet orifice between the nozzles.

3. A device as recited in claim 2, further comprising a partition wing attached to the jet orifice of the at least one nozzle for controlling fluid diffusion.

4. A device as recited in claim 1, further comprising a partition wing positioned adjacent to the jet orifice of the at least one nozzle for controlling fluid diffusion.

5. A a multi-nozzle weft insertion device for a fluidic jet shuttleless-loom, comprising:

a group of independent nozzles, each nozzle corresponding to a weft to be inserted, each nozzle having a jet orifice, the jet orifices pointing toward a weft path including a line of sight and the group having a center; and a streamlined weft guide provided at the jet orifice of at least one of said nozzles and having a streamlined wall surface forming a boundary layer flow as fluid passes adjacent thereto, where a weft flown from the at least one nozzle being moved along the boundary-layer flow formed on the streamlined wall surface of said weft guide and being blown gradually to the line of sight of the weft-path and said streamlined weft guide comprising a conoid streamlined weft guide provided at the center of said group of nozzles in a coaxial relationship with the line of sight of the weft-path.

6. A device as recited in claim 5, further comprising a partition wing positioned adjacent to the jet orifice of the at least one nozzle for controlling fluid diffusion.

7. A device as recited in claim 6, wherein said partition wing divides said guide into plural streamlined weft guides each having a different shape and streamlined curvature in dependence on a distance between the jet orifice of the nozzle and the line of sight of the weft path.

8. A a multi-nozzle weft insertion device for a fluidic jet shuttleless-loom, comprising:

a group of independent nozzles, each nozzle corresponding to a weft to be inserted, each nozzle having a jet orifice and the jet orifices pointing toward a weft path including a line of sight;

a streamlined weft guide provided at the jet orifice of at least one of said nozzles and having a streamlined wall surface forming a boundary layer flow as fluid passes adjacent thereto, where a weft blown from the at least one nozzle being moved along the boundary-layer flow formed on the streamlined wall surface of said weft guide and being blow gradually to the line of sight of the weft-path; and a partition wing positioned adjacent to the jet orifice of the at least one nozzle for controlling fluid diffusion, said partition wing dividing said guide into plural streamlined weft guides each having a different shape and streamlined curvature in dependence on a distance between the jet orifice of the nozzle and the line of sight of the weft path.

9. A multi-nozzle weft insertion device for a fluidic jet shuttleless-loom, comprising:

a group of independent nozzles, each nozzle corresponding to a weft to be inserted, each nozzle having a jet orifice and the jet orifice pointing toward a weft path including a line of sight;

a streamlined weft guide provided at the jet orifice of at least one of said nozzles and having a streamlined wall surface forming a boundary layer flow as fluid passes adjacent thereto, where a weft blown from the at least one nozzle being moved along the boundary-layer flow formed on the streamlined wall surface of said weft guide and being blow gradually to the line of sight of the weft-path; and a partition wing attached to the jet orifice of the at least one nozzle for controlling fluid diffusion, said partition wing dividing said guide into plural streamlined weft guides each having a different shape and streamline curvature in dependence on a distance between the jet orifice of the nozzle and the line of sight of the weft path.

10. A multi-nozzle weft insertion device, comprising:

at least two nozzles for propelling a weft in a fluid stream; and a weft guide in contact with the fluid stream and having a streamlined shape along which the fluid flows holding the weft in proximity to the shape and changing the direction of flow while maintaining a stable fluid stream.

11. A device as recited in claim 10 for inserting the weft into a channel and wherein the streamlined shape of said weft guide causes the weft to enter the channel along a weft-path line of sight.

12. A multi-nozzle weft insertion device, comprising:

at least two nozzles for positioning a weft in a fluid stream;

a weft guide in contact with the fluid stream and having a streamlined shape along which the fluid flows holding the weft in proximity to the shape; and nozzle partitions positioned between the nozzles and preventing weft entanglement.

13. A device as recited in claim 10, wherein the streamlined shape of said weft guide is selected from among a bullet-like shape, a spindle-like shape, an ovoid-like shape, a blunted spindle-like shape, an elliptical-like shape, a sheet like-shape and a sheet-like shape thicker in the middle.

14. A multi-nozzle weft insertion device, comprising:

at least two nozzles for propelling a weft in a fluid stream;

a weft guide in contact with the fluid stream and having a streamlined shape along which the fluid flows holding the weft in proximity to the shape; and nozzle partitions dividing said weft guide into sections, each section having a different streamlined shape.

15. A device as recited in claim 14, wherein the streamlined shape of the sections of said weft guide are selected from among a bullet-like shape, a spindle-like shape, an ovoid-like shape, a blunted spindle-like shape, an elliptical-like shape, a sheet-like shape and a sheet-like shape thicker in the middle.

16. A multi-nozzle weft insertion device, comprising:

at least two nozzles for propelling a weft in a fluid stream; and guide means for guiding the weft using streamline hydrodynamic flow characteristics of the fluid by changing the direction of flow and maintaining a stable fluid stream.

17. A device as recited in claim 16, further comprising means for preventing diffusion of the fluid as it is guided by said guide means.

* * * * *

UNITED STATES PATENT AND TRADEMARK OFFICE

CERTIFICATE OF CORRECTION

PATENT NO. : 4,691,745

DATED : September 8, 1987

INVENTOR(S) : TAKEKAWA ET AL.

It is certified that error appears in the above-identified patent and that said Letters Patent is hereby corrected as shown below:

Column 3, line 40, after "weft" insert ", causing the wefts to merge".

Column 4, line 45, after "effect" insert ",".

Column 5, line 51, change "indepdent" to "independent".

Column 6, line 17, change "flown" to "blown".

Signed and Sealed this

Twenty-sixth Day of July, 1988

*Attest:*

DONALD J. QUIGG

*Attesting Officer*

*Commissioner of Patents and Trademarks*